US006845721B1

(12) United States Patent
Doucet et al.

(10) Patent No.: US 6,845,721 B1
(45) Date of Patent: Jan. 25, 2005

(54) GROUND EMBEDDED WIRE TRACKS FOR A SHELVING SYSTEM HAVING MOBILE SHELF UNITS

(75) Inventors: Michel Doucet, St-Hilaire (CA); Pascal Gagnon, St-Romuald (CA); Serge Rainville, Charlesbourg (CA)

(73) Assignee: Montel Inc., Montmagny (CA)

( * ) Notice: Subject to any disclaimer, the term of this patent is extended or adjusted under 35 U.S.C. 154(b) by 0 days.

(21) Appl. No.: 10/703,441

(22) Filed: Nov. 10, 2003

(51) Int. Cl.[7] ..... B61B 10/00
(52) U.S. Cl. ..... 104/173.1; 312/201
(58) Field of Search ..... 104/173.1, 202, 104/287, 288; 312/198, 199, 201

(56) References Cited

U.S. PATENT DOCUMENTS

| | | | | | |
|---|---|---|---|---|---|
| 2,772,639 | A | * | 12/1956 | Ingold | 104/173.1 |
| 2,915,195 | A | * | 12/1959 | Crosby | 312/199 |
| 3,640,595 | A | * | 2/1972 | Staller et al. | 104/287 |
| 4,307,922 | A | * | 12/1981 | Rhodes, Jr. | 104/288 |
| 4,597,615 | A | * | 7/1986 | Steger | 312/201 |
| 6,112,917 | A | * | 9/2000 | Baker et al. | 312/201 |

* cited by examiner

*Primary Examiner*—Lars A. Olson
(74) *Attorney, Agent, or Firm*—François Martineau

(57) ABSTRACT

The shelving system has a number of electrically powered shelf units movable over ground, each shelf unit including an electronic circuit controlling the displacement of the shelf unit, a power cord connected to the shelf unit with of a power terminal rod, for feeding power to the shelf unit, and a network cable connected to the shelf unit with a network terminal rod, for allowing information to be exchanged with the electronic circuit. The shelving system further has a wire track that may be embedded in the ground, the wire track including an elongated main body having a hollow power wire channel housing the power cord and having an elongated opening allowing access to the power wire channel and forming an elongated power raceway allowing the power terminal rod to extend from the power wire channel to the shelf unit through the power raceway and to slide along the power raceway. The wire track main body further includes a hollow network wire channel housing the network cable and having an elongated opening allowing access to the network wire channel and forming an elongated network raceway allowing the network terminal rod to extend from the network wire channel to the shelf unit through the network raceway and to slide along the network raceway.

18 Claims, 7 Drawing Sheets

GROUND EMBEDDED WIRE TRACKS FOR A SHELVING SYSTEM HAVING MOBILE SHELF UNITS

FIELD OF THE INVENTION

The present invention relates to a shelving system having mobile shelf units, and more particularly to ground embedded wire tracks for a shelving system having mobile shelf units.

BACKGROUND OF THE INVENTION

Known shelving systems having mobile shelf units comprise a number of side-by-side shelf units each having a frame supporting a number of shelves. The shelf units are more particularly carried on ground rails that allow the shelf units to be displaced along the rails. A driving mechanism is used to move the shelf units along the rails. Manual and automatic driving mechanisms exist; in the automatic driving mechanisms, each shelf unit is powered for selective autonomous and independent displacement along the rails.

The mobile shelving systems equipped with automatic driving mechanisms conventionally allow the shelf units to be positioned adjacent to one another while freeing a single lane between two selected shelf-units. This lane will allow the passage therein of a person desiring to recuperate an article stored in the shelf units that are immediately adjacent to the lane. The other shelf units are horizontally stacked against each other on one side and the other of the lane, and if access to another shelf unit is required, the shelf units can be displaced along the rails to re-arrange the horizontal stacking of the shelf units, thereby eliminating the previous lane and forming a new lane next to the shelf unit to which access is desired. Consequently a minimal volume is occupied by the shelving system since a lane is not required between each two successively adjacent shelf units: a single open lane will instead be formed between two selected shelf units, while the others remain horizontally stacked.

Prior art automatic shelf units comprise a powered driving system which requires the mobile shelf units to be fed with electricity through electrically conducting wires or power cords. Due to the mobile nature of the shelf units, these power cords are conventionally connected to the shelf units by means of a number of hinged wire support arms. Each support arm comprises two bars pivotally connected to each other and each pivotally connected to a corresponding one of two successively adjacent shelf units. Each support arm supports a power cord that links the two shelf units. A first one of the shelf units is plugged to a power outlet, and consequently all the shelf units are serially connected to the power outlet. Each hinged wire support arm will remain in a contracted, folded position when the two shelf units that it links remain adjacent to each other, while it will be spread open in a deployed, unfolded position when a lane is formed between these two shelf units. The power cords, which are long enough to extend between two spaced-apart shelf units when a lane is formed therebetween, are prevented from sagging between the shelf units by being supported by their corresponding wire support arms.

Also, it is known to provide each shelf unit with an electronic control circuit including an interface device which includes a keyboard and a display screen, a CPU, RAM and ROM memory devices, I/O devices and suitable software components. Each control circuit is connected to the other control circuits, for example by means of a network-type cable, to allow digital communication between the control circuits. The purpose of the control circuits is to allow a control over the position of all mobile shelf units forming a shelving system. More particularly, the position of the shelf units will be controlled so that they move according to the desired position of the opened lane—position which may be input on an interface device of one of the control circuits. Also, it is known to provide sensor elements on the shelf units, to detect if any object or person would hinder the displacement of each shelf unit, especially in the opened lane between two shelf units. The control circuits will allow interaction of these sensor devices to help prevent the shelf units from accidentally crushing an object or a person. The network cables conventionally run along and are supported by the wire support arms, next to the power cords.

The problem with the above-mentioned method of supporting the power cords and the network cables is that the wire support arms are cumbersome, require space in a shelving system that aims to optimize space, and are aesthetically undesirable.

SUMMARY OF THE INVENTION

The present invention relates to a wire track destined to be embedded in the ground and for use in a mobile shelving system of the type comprising at least one electrically powered shelf unit movable over ground and a first wire linked to said shelf unit, said wire track comprising an elongated main body defining a first hollow wire channel therein for housing the first wire, and a first elongated opening allowing access to said first wire channel and forming a first elongated raceway for allowing the first wire to extend from said first wire channel to the shelf unit through said first raceway and to slide along said first raceway.

The present invention also relates to a shelving system comprising:

an electrically powered shelf unit movable over ground;

a first wire connected to said shelf unit;

a wire track destined to be embedded in the ground, said wire track comprising an elongated main body comprising a first hollow wire channel housing said first wire, with said first wire being movable along and within said first wire channel, said wire track main body further comprising a first elongated opening allowing access to said first wire channel and forming an elongated first raceway allowing said first wire to extend from said first wire channel to said shelf unit through said first raceway and to slide along said first raceway.

In one embodiment, said shelving system further comprises a second wire connected to said shelf unit, said wire track main body comprising a second hollow wire channel housing said second wire, with said second wire being movable along and within said second wire channel, said wire track main body further comprising a second elongated opening allowing access to said second wire channel and forming an elongated second raceway allowing said second wire to extend from said second wire channel to said shelf unit through said second raceway and to slide along said second raceway.

In one embodiment, said first and second wires comprise respective first and second rigid wire extension terminal rods linking said first and second wires to said shelf unit, said first and second terminal rods slidably extending through said first and second raceways, respectively.

In one embodiment, said first and second wires are movably extensible within said wire channel.

In one embodiment, said first and second wires are helical and wherein said first and second raceways are respectively narrower than the corresponding diameters of said first and second helical wires.

In one embodiment, said first wire is a power cord for transmitting power to said shelf unit and said second wire is a network cable for allowing said shelf unit to communicate through a network.

In one embodiment, said wire track main body comprises a base and a partial cover member attached to each other, with said partial cover member preventing accidental egress of said first and second wires from said first and second wire channels respectively, while allowing said first terminal rod to slidably extend through said first raceway and while allowing said second terminal rod to slidably extend through said second raceway.

In one embodiment, said shelving system further comprises wire retention means for preventing accidental egress of said first wire from said first wire channel.

In one embodiment, said first and second raceways are merged into a single raceway branching off into said first and second wire channels.

The present invention further relates to a shelving system comprising a number of electrically powered shelf units movable over ground, each said shelf unit comprising:

- an electronic circuit for controlling the displacement of said shelf unit;
- a power cord connected to said shelf unit with of a power terminal rod, for feeding power to said shelf unit; and
- a network cable connected to said shelf unit with a network terminal rod, for allowing information to be exchanged with said electronic circuit;

said shelving system further comprising a wire track destined to be embedded in the ground, said wire track comprising an elongated main body comprising a hollow power wire channel housing said power cord and having an elongated opening allowing access to said power wire channel and forming an elongated power raceway allowing said power terminal rod to extend from said power wire channel to said shelf unit through said power raceway and to slide along said power raceway, said main body further comprising a hollow network wire channel housing said network cable and having an elongated opening allowing access to said network wire channel and forming an elongated network raceway allowing said network terminal rod to extend from said network wire channel to said shelf unit through said network raceway and to slide along said network raceway.

DETAILED DESCRIPTION OF THE EMBODIMENTS

Figure 1:
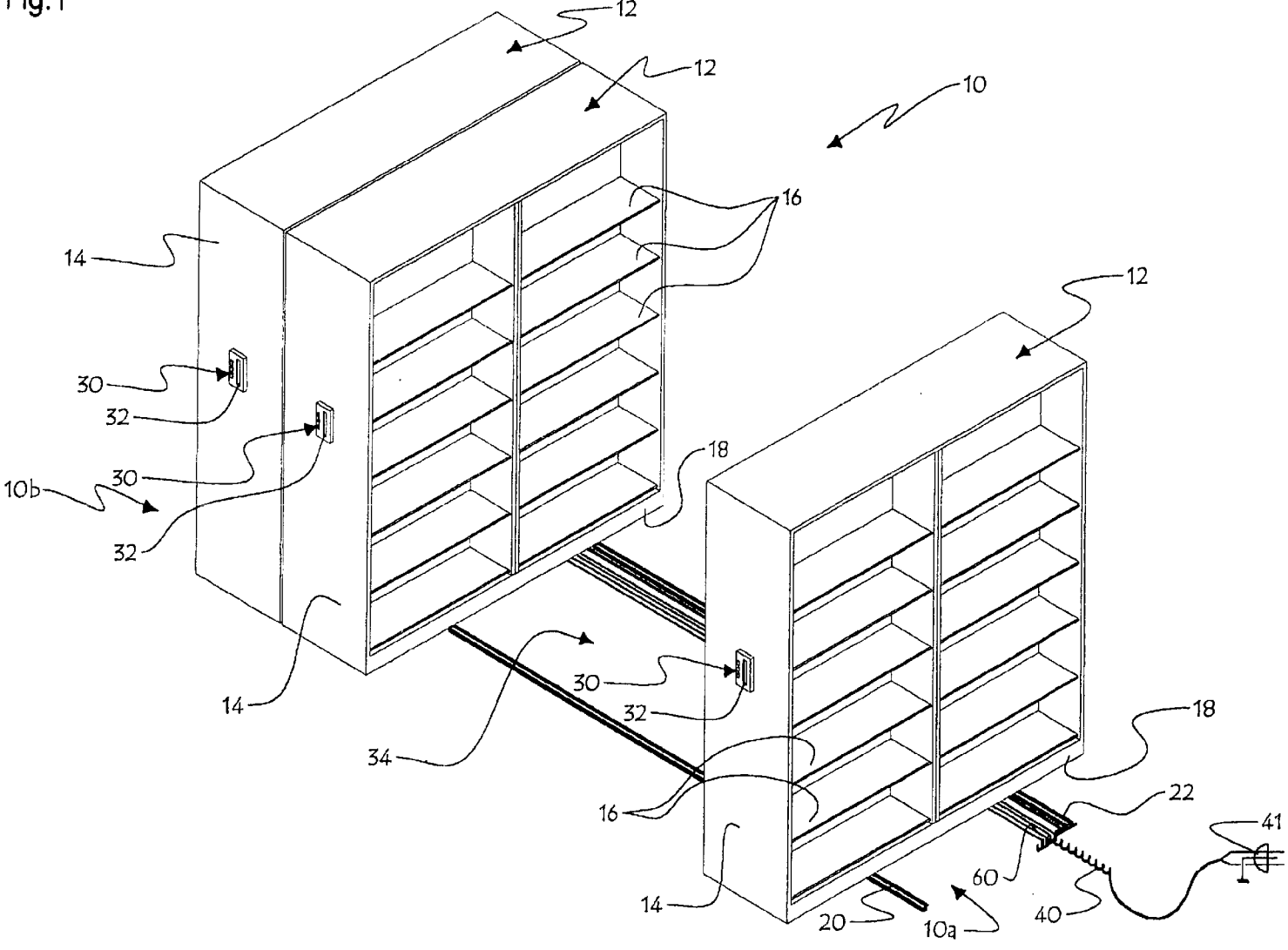
FIG. 1 is a perspective view of a shelving system according to the present invention.

FIG. 1 shows a shelving system 10 according to the present invention that defines an upstream end 10*a* and a downstream end 10*b*, and that comprises a number of electrically powered shelf units 12, for example three shelf units 12 as shown in FIG. 1, that are serially installed between the shelving system upstream end 10*a* and the shelving system downstream end 10*b*. Each shelf unit 12 is designed to support articles for storing purposes, and may have any suitable size or shape. For example, as shown in FIG. 1, each shelf unit 12 can comprise an upright rectangular frame 14 supporting a number of horizontal shelves 16. The shelf unit frame 14 defines a hollow base portion 18 (FIG. 2) that is at least partly opened towards the ground.

Figure 2:
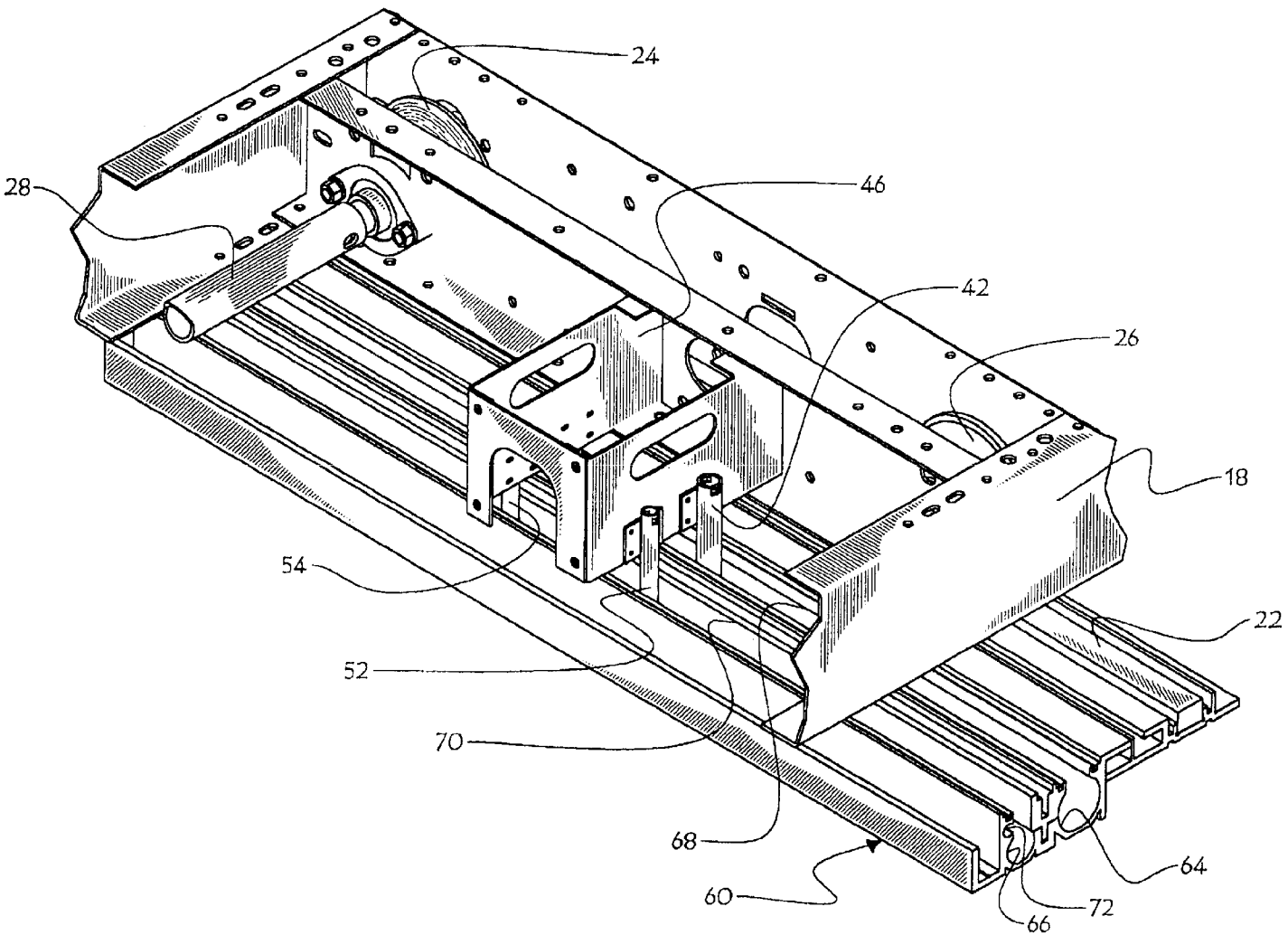
FIG. 2 is a partial enlarged perspective view of the base portion of a shelf unit, together with a portion of the wire track and the rail, of the shelving system of FIG. 1.

Shelving system 10 further comprises a number of parallel ground-embedded rails of known construction, for example two rails 20, 22 as shown in FIG. 1. Rails 20, 22 are destined to be engaged by wheels 24, 26 that are rotatably mounted within the downwardly opened base portion 18 of shelf units 12 (FIG. 2). Although only two wheels 24, 26 that engage rail 22 are shown in the drawings, it is understood that other similar wheels also engage rail 20, although they are concealed in FIG. 1. As known in the art, some wheels 24 are driven by a motor (not shown) installed within each electrically powered shelf unit 12 and connected to an axle 28, while other wheels are idle guide wheels 26. Thus, upon the powered shelf units 12 being selectively activated, they can be controlled to move along rails 20, 22, to position shelf units 12 according to a selected disposition. As described in the Background of the Invention section of the present specification, this movement of shelf units 12 is often accomplished to place all shelf units 12 in a horizontally stacked position except for an opened lane 34 that will be created between two selected shelf units 12, to allow access to the articles stored in one of these two selected shelf units.

Each shelf unit 12 also comprises an electronic control circuit 30 including an interface device 32, which may include for example a screen and a keyboard, and control cards (not shown) that may include for example a CPU, RAM and ROM memory devices, I/O devices and suitable software components, as known in the art. Control circuit 30 will be linked to and will co-operate with the other control circuits 30 of the other mobile shelf units 12 for allowing shelf units 12 to be moved and positioned in a suitable manner along rails 20, 22 and relative to one another, as described hereinafter. Furthermore, shelf units 12 may be provided with sensors (not shown) that allow them to detect the presence of a person or an object in opened lane 34 to prevent the two adjacent shelf units 12 to collapse against each other and accidentally crush the person or object located therebetween. Such electronic control circuits 30 are of known construction.

Shelving system 10 comprises a number of extensible power cords 40 (FIG. 3) that each feed power to a respective shelf unit 12 located immediately downstream of its corresponding power cord 40. More particularly, each extensible power cord 40 links a mobile shelf unit 12 to a preceding, upstream shelf unit 12. In one embodiment, a first fixed shelf unit (not shown) is also provided in shelving system 10, upstream of all mobile shelf units, with the first power cord 40 linking the first mobile shelf unit 12 to this fixed shelf unit; this first fixed shelf unit would itself be connected to a power outlet in turn connected the local electric power grid. It is also envisioned to provide a second fixed shelf unit (not shown) downstream of all mobile shelf units, with a last extensible power cord 40 linking the most downstream mobile shelf unit 12 to this second fixed shelf unit if power is required in this second fixed shelf unit.

In the embodiment shown in FIG. 1, however, the first mobile shelf unit 12 is linked with its power cord 40 directly to an electric power outlet 41 connecting power cord 40 to the local electric power grid. In any event, each mobile shelf unit 12 is provided with a corresponding extensible power cord 40 linking it to a preceding, downstream shelf unit 12 or to the local electric grid in the case of the first mobile shelf unit 12. Thus, all shelf units 12 are serially connected to the power source, for allowing all mobile shelf units 12 to be fed with power.

Figure 3:
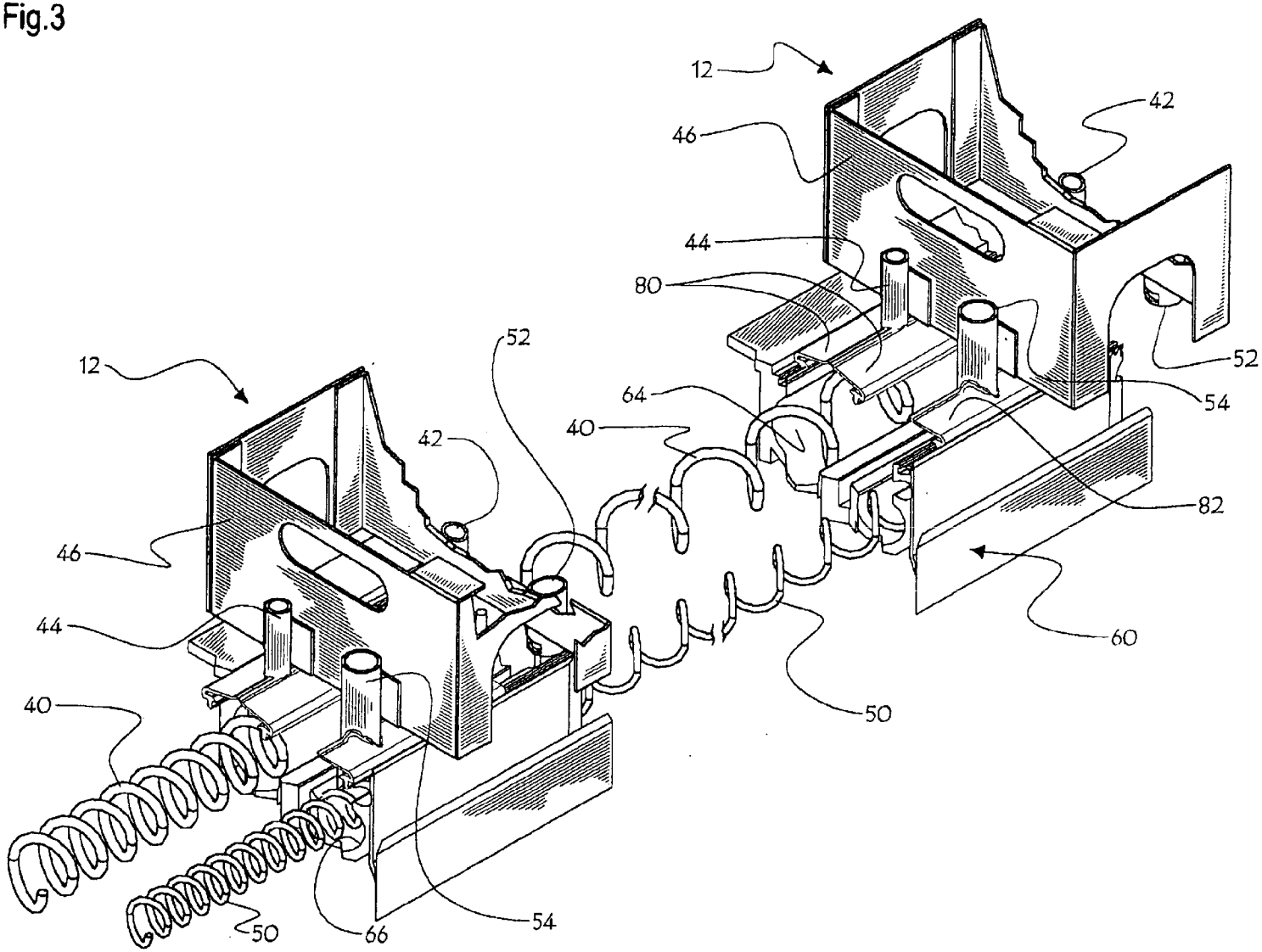
FIG. 3 is a partial enlarged perspective view of a pair of terminal rod support frames with their corresponding terminal rods respectively part of two shelf units of the shelving system of FIG. 1, together with a broken partial view of the wire track and a first power cord and network cable being extended between the two shelf units, and a partial view of a second power cord and network cable in a contracted position.

As shown in FIGS. 2 and 3, each extensible power cord 40 that links two mobile shelf units 12 is connected at its respective first and second ends to respective power terminal rods 42 and 44 provided on the two mobile shelf units that it links. More particularly, each shelf unit 12 is provided with a power input terminal rod 42 that is located upstream of the shelf unit power charge itself (not shown) and a power output terminal rod 44 that is located downstream of the shelf unit power charge itself. Terminal rods 42, 44 are operatively connected to the power charge of the shelf unit 12 in a known fashion, and are attached to a terminal rod support frame 46 that is in turn fixedly attached to the base portion 18 of the shelf unit frame. Power input terminal rod 42 allows power to be transferred to the power charge of mobile shelf unit 12 from its corresponding upstream power cord 40, while power output terminal rod 44 allows power to be transferred from this mobile shelf unit 12 to a downstream power cord 40 linking it to an adjacent downstream mobile shelf unit 12.

Shelving system 10 further comprises a number of extensible network cables 50 (FIG. 3) that allow digital information to be transferred therethrough between the control circuits 30 of respective shelf units 12. More particularly, each extensible network cable 50 links two mobile shelf units 12 to each other. Thus, all mobile shelf units 12 are serially connected by means of network cables 50, for allowing the control circuits 30 of all mobile shelf units 12 to share digital information.

As shown in FIGS. 2 and 3, each extensible network cable 50 that links two mobile shelf units 12 is connected at its respective first and second ends to respective network terminal rods 52 and 54 provided on the two mobile shelf units that it links. More particularly, each shelf unit 12 is provided with a first network terminal rod 52 that is located upstream of the shelf unit control circuit 30 itself and a second network terminal rod 54 that is located downstream of the shelf unit control circuit 30 itself. Network terminal rods 52, 54 are operatively connected to control circuit 30 in a known fashion, and are attached to terminal rod support frame 46 laterally spacedly adjacent to the power terminal rods 42, 44. First network terminal rod 52 allows digital information to be transferred from the upstream mobile shelf unit control circuits 30 to its corresponding shelf unit control circuit 30, while second network terminal rod 54 allows digital information to be transferred from its corresponding shelf unit control circuit 30 to the downstream mobile shelf unit control circuits 30. Thus, all control circuits 30 are interconnected by means of network cables 50.

It can be seen that extensible power cord 40 and extensible network cable 50 are helical wires that can consequently adopt contracted positions wherein the spires of the helical wires are compressed towards each other, and extracted positions wherein the spires of the helical wires are spread apart.

As shown in FIGS. 1–5, and according to the present invention, shelving system 10 comprises a wire track 60 destined to be embedded in the ground. Wire track 60 comprises an elongated main body 62 defining a power wire channel 64 sized and shaped to house power cord 40 therein, and a network wire channel 66 sized and shaped to house network cable 50 therein. Wire track 60 is provided with an elongated top opening allowing access to power wire channel 64 and forming an elongated power raceway 68 allowing the power terminal rods 42, 44 to extend therethrough from the shelf unit frame base portion 18 into power wire channel 64 (see FIGS. 2 and 5). Wire track 60 is also provided with an elongated top opening allowing access to network wire channel 66 and forming an elongated network raceway 70 allowing the network terminal rods 52, 54 to extend therethrough from the shelf unit frame base portion 18 into network wire channel 66. Consequently, power terminal rods 42, 44 and network terminal rods 52, 54 can respectively slide along their respective power and network raceways 68 and 70 during the displacements of shelf unit 12 along rails 20, 22, while continuously projecting into their respective power and network wire channels 64 and 66.

An optional auxiliary wire channel 72 is further provided in the wire track main body 62. Auxiliary channel 72 has an elongated opening 74 that allows access therein from network raceway 70. Auxiliary wire channel 72 can be used to pass therein an optional, non-extensible auxiliary wire (not shown), such as an additional power cord used to provide power to another group of mobile shelf units (not shown) located beyond the group of mobile shelf units 12 movable along wire track 60.

Wire track main body 62 comprises an elongated transverse flange 76 located on one side of main body 62. The outer free edge of flange 76 is destined to co-operatively abut against a surface of rail 22, to which it is fixedly attached. Wire track main body 62 further defines an elongated upwardly oriented L-shaped side wall 78 that is destined to be positioned on the opposite side of rail 22 and that extends upwardly short of the top edge of main body 62. The upper free edge of side wall 78 is destined to provide a seat for example for a concrete floor tile F, so as to stabilize wire track 60.

Wire track main body 62 is provided with a pair of resilient sealing strips 80, 80 that are snap-fitted into grooves provided on the upper surface of main body 62 to cover power raceway 68. Sealing strips 80 can be resiliently yieldingly upwardly spread apart to allow the power terminal rods 42, 44 to extend through power raceway 68, while otherwise preventing macroparticulate debris from entering power wire channel 64. Wire track main body 62 is also provided with a resilient sealing strip 82 that is snap-fitted into a groove provided on the upper surface of main body 62 to cover network raceway 70. Sealing strip 82 can be resiliently yieldingly upwardly folded to allow the network terminal rods 52, 54 to extend through network raceway 70, while otherwise preventing macroparticulate debris from entering network wire channel 66.

In use, power cord 40 and network cable 50 are installed within their respective wire channels 64 and 66 that are sized to loosely receive same. Since raceways 68 and 70 are respectively narrower than the respective diameters of helical power cord 40 and helical network cable 50, power cord 40 and network cable 50 are prevented from accidental egress out of their respective wire channels 64 and 66. Power cord 40 and network cable 50 can be extended and retracted within their respective wire channels 64 and 66 as relative movement of each two successively adjacent shelf units 12 occurs. FIG. 3 shows an unconstrained power cord 40 and an unconstrained network cable 50 on the left hand side thereof, linking the left-hand side shelf unit 12 to another non-illustrated shelf unit which would be closely adjacent to the left-hand side shelf unit 12 of FIG. 3; and further shows an extracted power cord 40 and an extracted network cable 50 tensioned between the two illustrated shelf units 12 which would be spread apart to form a lane between the two illustrated shelf units 12. It is understood that the extension and retraction capacity of power cord 40 and network cable 50 are adapted to compensate all relative movement capacity of two successively adjacent shelf units 12, by providing suitable lengths, radii and pitches to power cord 40 and network cable 50.

It is understood that wire track 60 is preferably made of a suitable electrically insulating material, whereby magnetic interference between power cord 40 and network cable 50 is minimized.

Figure 4:
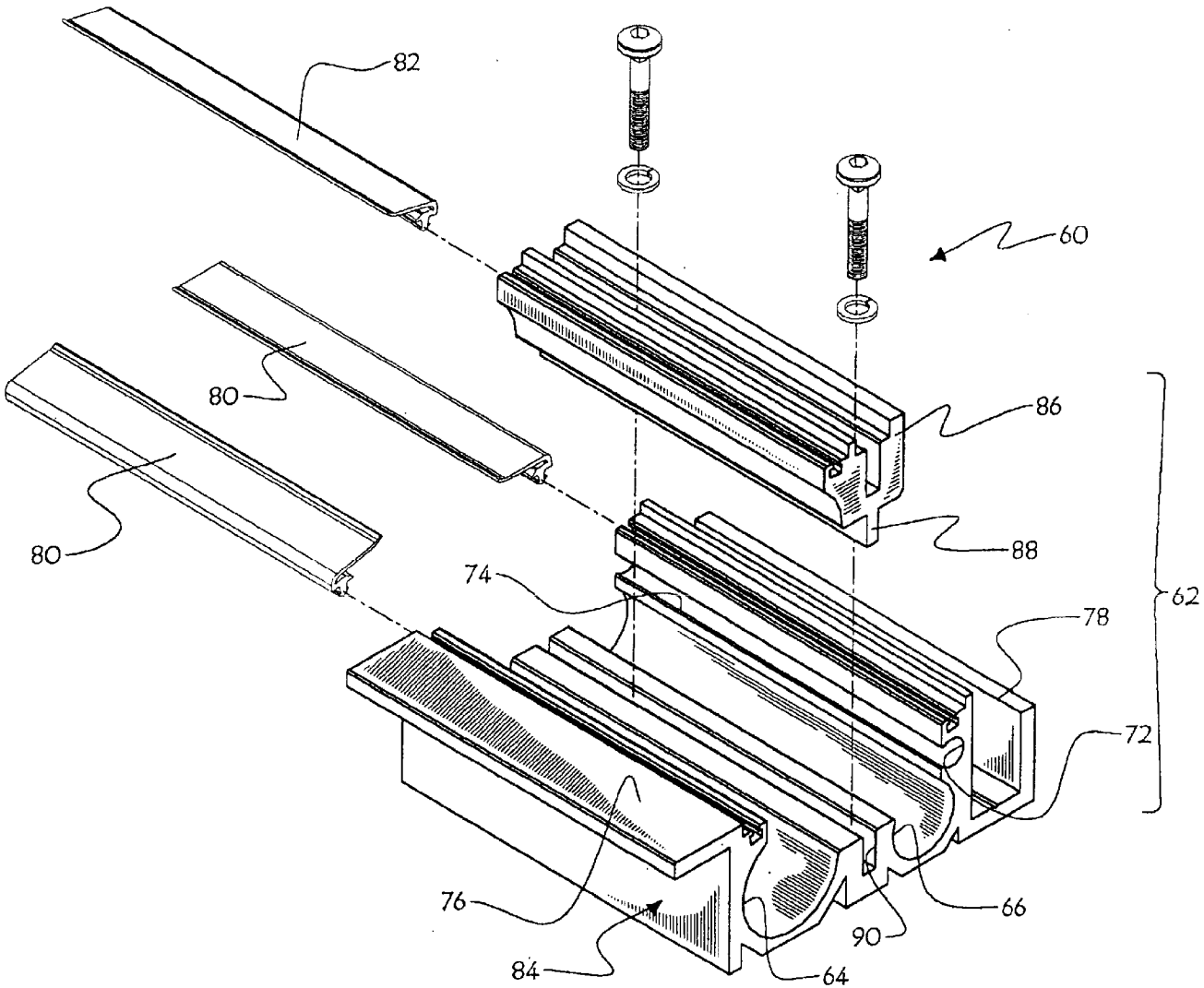
FIG. 4 is an exploded enlarged perspective view of a section of the wire track of the shelving system of FIG. 1.
Figure 5:
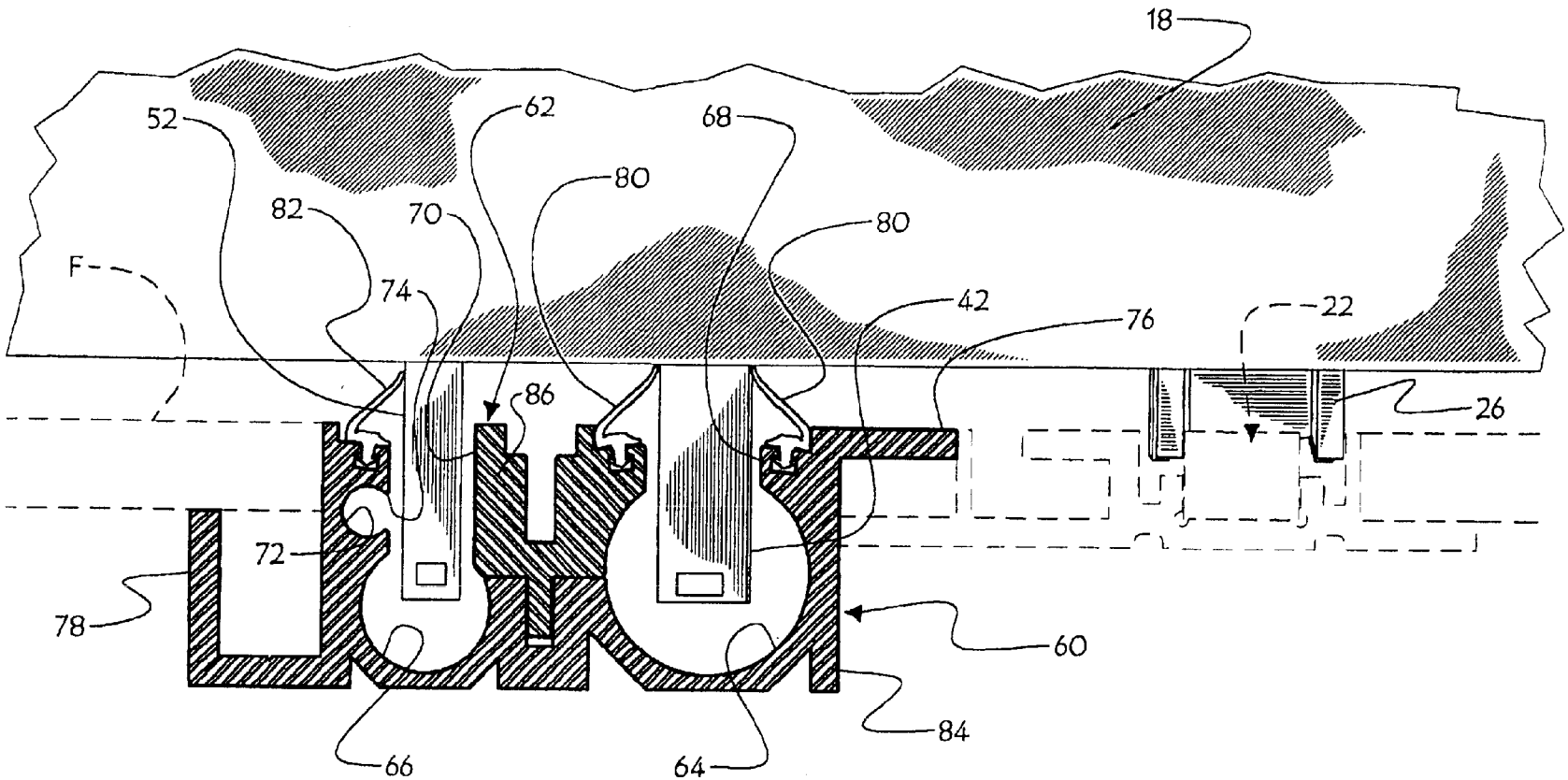
FIG. 5 is an enlarged cross-sectional view of the wire track of the shelving system of FIG. 1, further partly showing the shelf unit base portion and suggesting in dotted lines the adjacent floor and rail.

As shown in FIGS. 4 and 5, wire track main body 62 is formed of an elongated base 84 resting on the ground and engaged by an elongated partial cover member 86 bolted thereto. Partial cover member 86 has a downwardly projecting lip 88 that engages a complementary groove 90 centrally located in base 84, for improved structural integrity of the base and partial cover member assembly (FIG. 4). Partial cover member 86, as its name suggests, does not entirely enclose channels 64, 66, but only partially covers same. Indeed, the purpose of partial cover member 86 is to allow power cord 40 and network cable 50 to readily have radial access into or out of their respective wire channels 64 and 66 when partial cover member 86 is removed (see exploded view of FIG. 4); while preventing accidental egress of power cord 40 and network cable 50 out of their respective wire channels 64 and 66 and allowing sliding engagement of terminal rods 42, 44 and 52, 54 along their respective raceways 68 and 70 when partial cover member 86 is attached to base 84. It can consequently be seen that partial cover member 86 forms at least part of the inner walls of both wire channels 64, 66, even though this proportion might be a relatively small one as is the case in the embodiment shown in the annexed drawings wherein partial cover member 86 forms a very small proportion of the inner wall of network wire channel 66.

Figure 6:
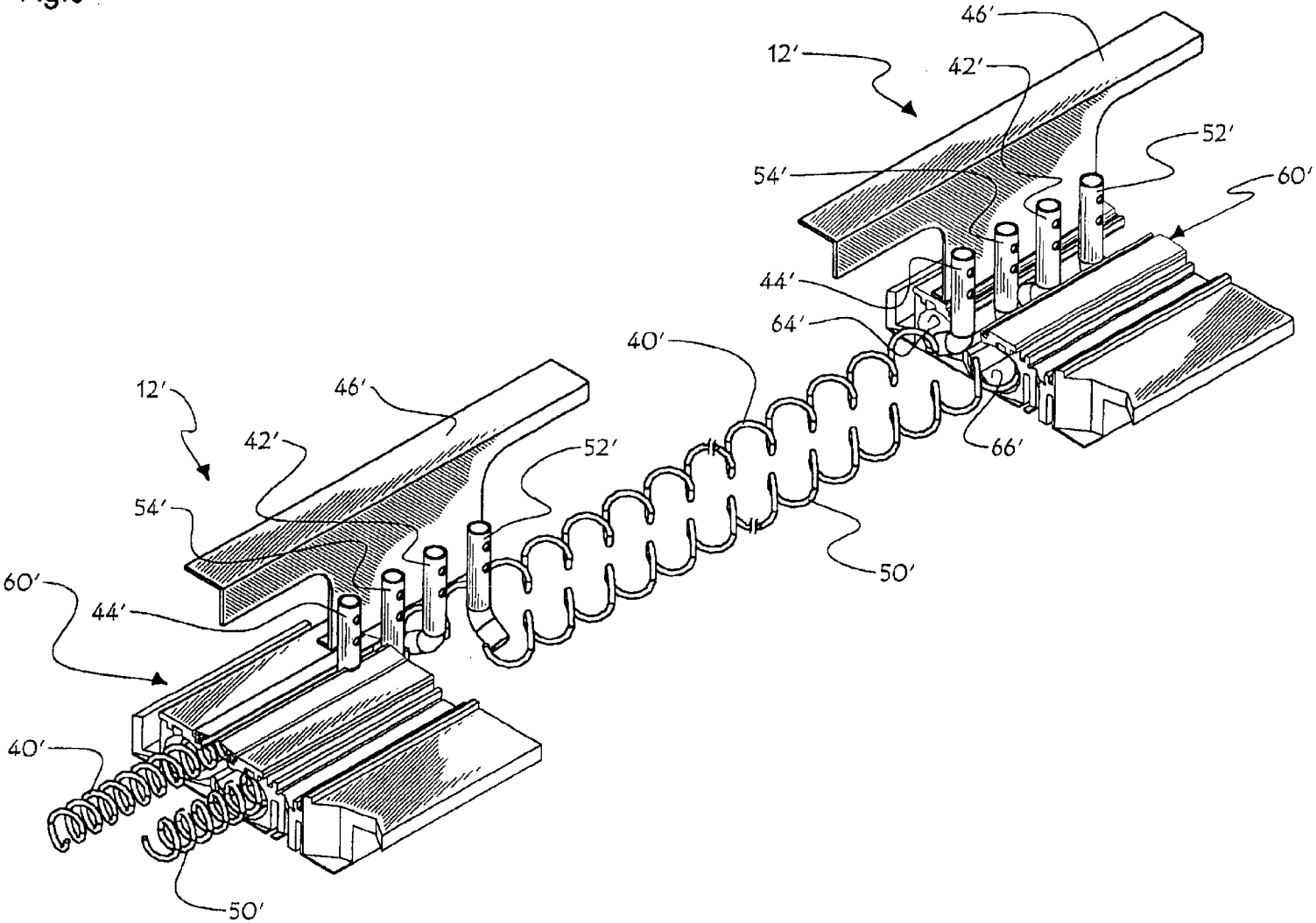
FIG. 6 is a partial enlarged perspective view of a pair of terminal rod support frames with their corresponding terminal rods respectively part of two shelf units of a shelving system according to an alternate embodiment, together with a broken partial view of the wire track and a first power cord and network cable being extended between the two shelf units, and a partial view of a second power cord and network cable being in a contracted position.
Figure 7:
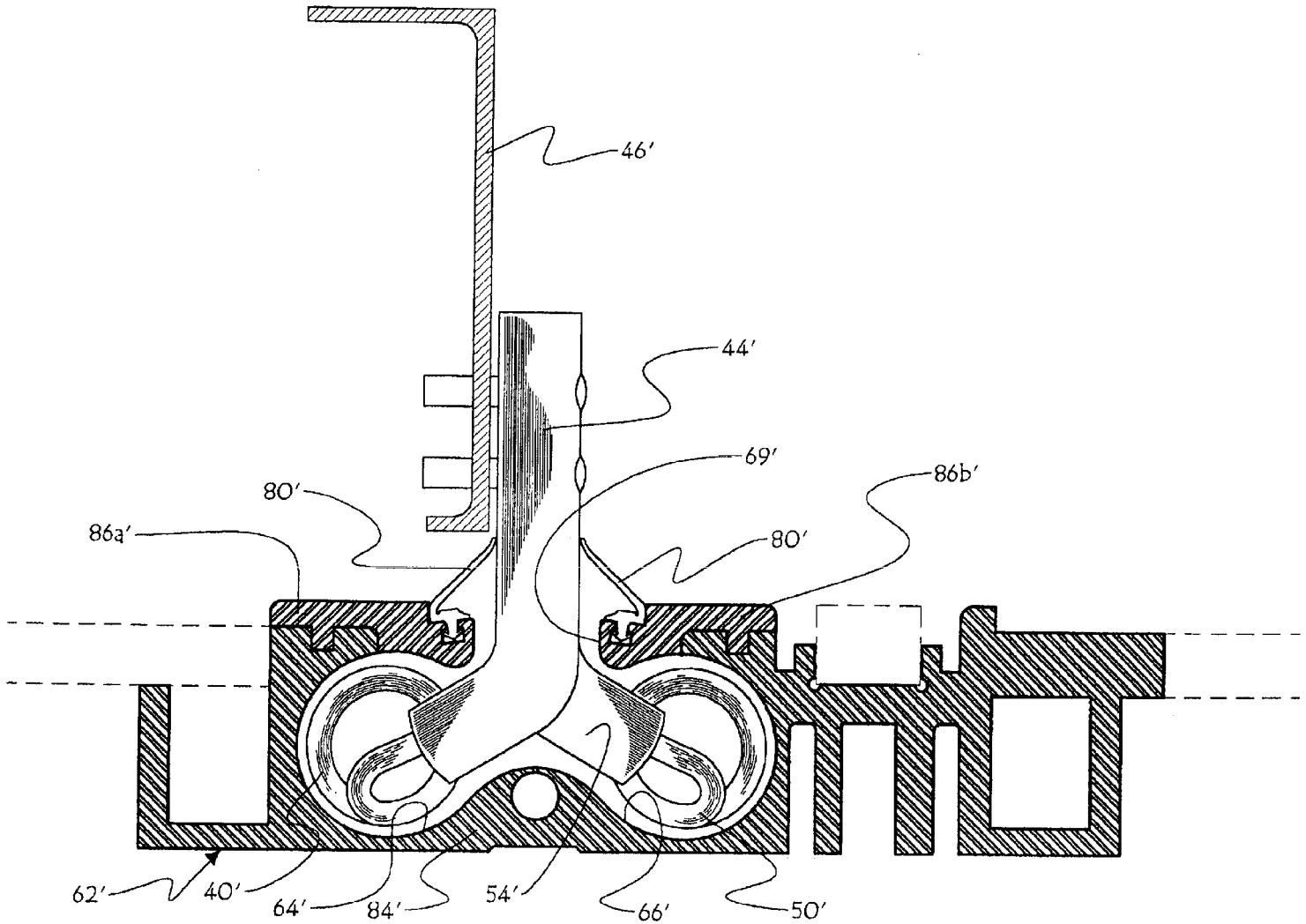
FIG. 7 is an enlarged cross-sectional view of the wire track shown in FIG. 6, further showing part of the shelf unit terminal rod support frame and its corresponding terminal rods and suggesting in dotted lines the adjacent floor and rail.

FIGS. 6 and 7 show an alternate embodiment of the present invention, which is similar to the embodiment detailed hereinabove, except as detailed hereinafter. In the alternate embodiment of FIGS. 6 and 7, reference numerals are primed, with primed numerals relating to similar elements referred to by the same non-primed numerals in the embodiment of the invention shown in FIGS. 1–5.

In the embodiment of FIGS. 6–7, power terminal rods 42', 44' and network terminal rods 52', 54' are installed in a co-linear fashion, and are elbowed at their bottom end and oriented towards one of two sides: both power terminal rods 42', 44' are oriented in a first direction, and both network terminal rods 52', 54' are oriented in a second direction. The main body 62' of wire track 60' is formed with two wire channels 64' and 66' having an equal diameter to respectively house the power cord 40' and the network cable 50' that also have a same diameter. The cover member is formed of two elongated cover portions 86*a*' and 86*b*' that are attached on either side of a base 84' and that extend inwardly over wire channels 64' and 66' respectively. A single raceway 69' is provided in main body 62', between the two cover portions 86*a*', 86*b*', raceway 69' branching off into both wire channels 64', 66'. Deformable resilient sealing strips 80', 80' are snap-fitted into grooves made along the inner edge of the cover portions 86*a*', 86*b*' to extend over raceway 69'. Thus, in this alternate embodiment, all terminal rods 42', 44', 52', 54' slide within a same raceway 69', and two distinct cover portions 86*a*', 86*b*' prevent accidental egress of power cord 40' and network cable 50' from their respective wire channels 64', 66'.

Any other modification to the present invention which would be obvious to someone skilled in the art of the invention, is considered to be included in the scope of the appended claims.

For example, in one alternate embodiment, the partial cover member could take other alternate forms: a resiliently deformable strip—in fact, sealing strips 80, 80, 82 could act as a partial cover member; a number of transverse tie straps removably attached at regular intervals along the otherwise opened wire track base; or any other suitable element or combination of elements that would help prevent accidental egress of the wire or wires from within their wire channels, while allowing the wires to be installed in or removed from the wire channels when the cover member is released from the main body base. The base and partial cover could also be symmetrically identical portions of the wire track main body attached to each other, or the base could actually be much smaller than the cover.

In one alternate embodiment, the helical power cord and network cable would have a same diameter and would be interlaced in a same wire channel located within the wire track.

In another alternate embodiment, only the power cord or the network cable would be embedded in a wire track having a single wire channel.

In another embodiment, the power cord and the network cable would be merged into a single, common wire.

In one embodiment, the extensible power cord and/or the extensible network cable could have a variable length by other means than by the power cord and network cable being helical. For example, this variable length could be achieved by providing a deformable, elastic wire; by providing a longer wire that could slidably move along its wire channel; or by winding the wire on a spring-loaded rotatable spool that would rotate to unwind the wire to provide additional length thereto when adjacent shelf units are spaced apart, and that would automatically wind the wire about the spring-loaded spool when the adjacent shelf units are brought closer to each other. Generally, it can be said that the wires movably engage their respective wire channels to compensate the relative movements of the two shelf units that they link.

In one embodiment, the power cord and/or the network cable would be prevented from accidental egress from their corresponding wire channels by any suitable wire retention means, for example with a wire shoulder member which would be different from the shoulder member shown in FIGS. 1–7, namely the spires of the helical wires. This wire shoulder member could be any suitable element attached to or installed on or engaged by the wire which would prevent it from accidental egress from its wire channel, such as for example a disc through which a linear wire extends.

In one embodiment, the power cord and/or the network cable would extend through the wire track raceway itself, without being connected to terminal rods, with the power cord being connected directly to the shelf unit power charge and with the network cable being connected directly to the network I/O connector of the control circuit. In this respect, the terminal rods can be considered to be simple extensions of the wires used to provide a rigid downwardly oriented trajectory to the wires.

We claim:

1. A wire track destined to be embedded in the ground and for use in a mobile shelving system of the type comprising at least one electrically powered shelf unit movable over ground and a first wire linked to said shelf unit, said wire track comprising an elongated main body defining a first hollow wire channel therein for housing the first wire, and a first elongated opening allowing access to said first wire channel and forming a first elongated raceway for allowing the first wire to extend from said first wire channel to the shelf unit through said first raceway and to slide along said first raceway.

2. A wire track as defined in claim 1, wherein said main body defines a second hollow wire channel therein for housing a second wire connected to the shelf unit, and a second elongated opening allowing access to said second wire channel and forming a second elongated raceway for allowing the second wire to extend from said second wire channel to the shelf unit through said second raceway and to slide along said second raceway.

3. A wire track as defined in claim 2, wherein said main body comprises a base and a partial cover member attached to each other.

4. A shelving system comprising:

an electrically powered shelf unit movable over ground;

a first wire connected to said shelf unit;

a wire track destined to be embedded in the ground, said wire track comprising an elongated main body comprising a first hollow wire channel housing said first wire, with said first wire being movable along and within said first wire channel, said wire track main body further comprising a first elongated opening allowing access to said first wire channel and forming an elongated first raceway allowing said first wire to extend from said first wire channel to said shelf unit through said first raceway and to slide along said first raceway.

5. A shelving system as defined in claim 4, wherein said first wire comprises a first rigid wire extension terminal rod linking a first extremity of said first wire to said shelf unit, said first terminal rod extending through said first raceway and being slidable therealong.

6. A shelving system as defined in claim 5, wherein said first wire is movably extensible within said wire channel.

7. A shelving system as defined in claim 6, wherein said power cord is helical and wherein said first raceway is narrower than the corresponding diameter of said first helical wire.

8. A shelving system as defined in claim 4, further comprising a second wire connected to said shelf unit, said wire track main body comprising a second hollow wire channel housing said second wire, with said second wire being movable along and within said second wire channel, said wire track main body further comprising a second elongated opening allowing access to said second wire channel and forming an elongated second raceway allowing said second wire to extend from said second wire channel to said shelf unit through said second raceway and to slide along said second raceway.

9. A shelving system as defined in claim 8, wherein said first and second wires comprise respective first and second rigid wire extension terminal rods linking said first and second wires to said shelf unit, said first and second terminal rods slidably extending through said first and second raceways, respectively.

10. A shelving system as defined in claim 9, wherein said first and second wires are movably extensible within said wire channel.

11. A shelving system as defined in claim 10, wherein said first and second wires are helical and wherein said first and second raceways are respectively narrower than the corresponding diameters of said first and second helical wires.

12. A shelving system as defined in claim 11, wherein said first wire is a power cord for transmitting power to said shelf unit and said second wire is a network cable for allowing said shelf unit to communicate through a network.

13. A shelving system as defined in claim 11, wherein said wire track main body comprises a base and a partial cover member attached to each other, with said partial cover member preventing accidental egress of said first and second wires from said first and second wire channels respectively, while allowing said first terminal rod to slidably extend through said first raceway and while allowing said second terminal rod to slidably extend through said second raceway.

14. A shelving system as defined in claim 4, wherein said wire track main body comprises a base and a partial cover member attached to each other, with said partial cover member preventing accidental egress of said first wire from said wire channel while allowing said first wire to slidably extend through said first raceway.

15. A shelving system as defined in claim 4, further comprising wire retention means for preventing accidental egress of said first wire from said first wire channel.

16. A shelving system as defined in claim 8, wherein said first and second raceways are merged into a single raceway branching off into said first and second wire channels.

17. A shelving system comprising a number of electrically powered shelf units movable over ground, each said shelf unit comprising:

an electronic circuit for controlling the displacement of said shelf unit;

a power cord connected to said shelf unit with of a power terminal rod, for feeding power to said shelf unit; and a network cable connected to said shelf unit with a network terminal rod, for allowing information to be exchanged with said electronic circuit;

said shelving system further comprising a wire track destined to be embedded in the ground, said wire track comprising an elongated main body comprising a hollow power wire channel housing said power cord and having an elongated opening allowing access to said power wire channel and forming an elongated power raceway allowing said power terminal rod to extend from said power wire channel to said shelf unit through said power raceway and to slide along said power raceway, said main body further comprising a hollow network wire channel housing said network cable and having an elongated opening allowing access to said network wire channel and forming an elongated network raceway allowing said network terminal rod to extend from said network wire channel to said shelf unit through said network raceway and to slide along said network raceway.

18. A shelving system as defined in claim 17, wherein said power raceway and said network raceway are merged into a same raceway branching off into said power wire channel and said network wire channel.

* * * * *